US005218786A

United States Patent [19]

Takahashi

[11] Patent Number: 5,218,786

[45] Date of Patent: Jun. 15, 1993

[54] APPARATUS FOR GRINDING FERRULES FOR RIBBON TYPE OPTICAL FIBERS

[75] Inventor: Mitsuo Takahashi, Matsudo, Japan

[73] Assignee: Seikoh Giken Co., Ltd., Matsudo, Japan

[21] Appl. No.: 890,825

[22] Filed: Jun. 1, 1992

Related U.S. Application Data

[62] Division of Ser. No. 841,414, Feb. 26, 1992.

[30] Foreign Application Priority Data

Oct. 4, 1991 [JP] Japan ..... 3-284038

[51] Int. Cl.[5] ..... B24B 9/14; B24B 47/02

[52] U.S. Cl. ..... 51/71; 51/96; 51/124 R; 51/234

[58] Field of Search ..... 51/91 R, 96, 121, 124 R, 51/124 L, 125.5, 224, 230, 234, 283 R, 283 E, 217 R

[56] References Cited

U.S. PATENT DOCUMENTS

| | | | |
|---|---|---|---|
| Re. 30,357 | 8/1980 | Henry | 51/234 |
| 1,610,206 | 12/1926 | Gabriel et al. | 51/217 R |
| 2,600,432 | 6/1952 | Sanders | 51/234 |
| 3,279,127 | 10/1966 | Giezentanner | 51/124 R |
| 3,902,282 | 9/1975 | Roscoe et al. | 51/234 |
| 4,517,770 | 5/1985 | Leibowitz | 51/125.5 |
| 4,766,705 | 8/1988 | Dholakia | 51/328 |
| 4,928,435 | 5/1990 | Masaki et al. | 51/284 R |

FOREIGN PATENT DOCUMENTS

| | | | |
|---|---|---|---|
| 142062 | 6/1986 | Japan | 51/124 L |

*Primary Examiner*—Bruce M. Kisliuk
*Assistant Examiner*—Bryan Reichenbach
*Attorney, Agent, or Firm*—Spencer, Frank & Schneider

[57] ABSTRACT

A method of grinding ferrules for ribbon type optical fibers wherein the method comprises the steps of locating the end surfaces of the ferrules with respect to a grinding surface of a grinding member, reciprocatingly turnably displacing the ferrules along an arched locus, and grinding the end surfaces of the ferrules with the grinding wheel. To practice the method, an apparatus including a ferrule holding member, a supporting member having the ferrule holding member turnably supported thereon, a driving unit in the form of an electric motor including a reduction gear, a connecting rod bridged between the driving unit and the ferrule holding member to reciprocably turn the ferrule holding member, a grinding member mounted on a frame of the apparatus, a grinding position adjusting unit, a compression spring for normally biasing the supporting member in the upward direction, and a base board mounted on the frame of the apparatus for turning the supporting member about an intermediate position thereof. The end surfaces of the ferrules are normally immovably held at positions at a right angle relative to the grinding surface of the grinding member. Alternatively, they may immovably be held at positions where the ferrules are inclined at a predetermined inclination angle.

12 Claims, 7 Drawing Sheets

APPARATUS FOR GRINDING FERRULES FOR RIBBON TYPE OPTICAL FIBERS

This is a division of application Ser. No. 07/841,414 filed Feb. 26th, 1992 still pending.

BACKGROUND OF THE INVENTION

1. Field of the Invention

The present invention relates generally to a method and an apparatus for grinding ferrules for ribbon type optical fibers used for a ribbon type optical fiber connector, an optical attenuator and other optical circuit component each of which is used for the purpose of accomplishing a multi-core type integral connection in an optical fiber communication circuit system. More particularly, the present invention relates to a method and an apparatus for grinding the foremost end surfaces of ferrules for ribbon type optical fibers in consideration of the contour of each ground surface after completion of a grinding operation wherein an undesirable loss due to reflective return of an incident light beam at a joint end surface of each optical circuit component can be minimized.

2. Description of the Related Art

At present, many optical components such as optical connectors each used for connecting an opposing pair of ferrules to each other, optical attenutaors each used for attenuating the intensity of an incident light beam, optical branching/coupling units each used for branching an optical signal or coupling optical signals to each other have been employed in optical fiber communication circuit systems.

As the number of application fields for optical fiber communication circuit systems increases year by year, not only the number of optical circuit components but also the time and cost required for laying optical fibers throughout a communication circuit system are increased and enlarged enormously.

To solve the foregoing problem, a proposal has been made as to a method of providing so-called ribbon type optical fibers each composed of four to twelve optical fibers arranged in a flat plate-shaped configuration. In practice, ribbon type optical fibers have been put into practical use for communication circuit systems and their fields of application have rapidly expanded year by year.

When an optical fiber communication circuit system is built by using a number of optical fibers, the number of joint locations where optical fibers are jointed to each other increases unavoidably. Especially, in a case where a high speed optical fiber communication system having a large capacity is built in the same manner as mentioned above, there is a need to take account of a substantial loss due to reflective return of an incident light beam at a joint location as well as a joint loss due to connection of optical fibers to each other in the communication circuit system.

To facilitate understanding of the present invention, a conventional optical connector employable for ribbon type optical fibers will briefly be described below with reference to FIGS. 8(*a*) and 8(*b*).

FIG. 8(*a*) is a sectional plan view of a conventional typical optical connector for a pair of ribbon type optical fibers each composed of four optical fibers, particularly illustrating that their joint end surfaces are ground at a right angle relative to the longitudinal direction of the optical connector, and FIG. 8(*b*) is a sectional side view of the optical connector taken along line A—A in FIG. 8(*a*).

Joint end surfaces 56*a* and 56*b* of a pair of ferrules 55*a* and 55*b* each having a rectangular cross-sectional contour and including four naked optical fibers 52*a* and 52*b* with sheathes 51*a* and 51*b* peeled therefrom are ground at a right angle relative to the longitudinal direction of the optical connector.

The joint end surfaces 56*a* and 56*b* are jointed to each other by inserting the ferrules 55*a* and 55*b* into an alignment sleeve 57.

With respect to the conventional optical connector constructed in the above-described manner, since there inevitably arises a minor machining error during a grinding operation performed for the end surfaces of the optical fibers, they do not come in close contact with each other when they are jointed to each other in the alignment sleeve 57. This leads to the result that there arises a joint loss of about 0.35 dB derived from a Fresnel loss due to the presence of an air layer between the adjacent optical fibers. In addition, when an incident light beam L is reflected at the joint surface and returns to a light source (not shown), a reflective return loss is caused, resulting in an undesirable loss of about 10 db.

In a case of ferrules for an optical connector having single cored-optical fibers used therefor, to obviate the foregoing drawback, another proposal has been made as to a method of eliminating Fresnel loss and reducing reflective return loss by bringing a pair of single cored-optical fibers into direct contact with each other at apexes of spherical surfaces of the optical fibers. Additionally, as a modified embodiment, it is thinkable that reflective return loss could be reduced to an ultimate extent by grinding the end surfaces of the ferrules with an inclination angle of eight degrees or more relative to a plane perpendicular to an axis of the optical fibers so as to assure that a reflected return light beam is irradiated only to a clad layer of each optical fiber without any return to the light source.

However, since ferrules for ribbon type optical fibers are used in a different application field from that of ferrules for single cored-optical fibers, a variety of research is presently being conducted for the development of ribbon type optical fibers, particularly with respect to the contour of the end surface of each optical fiber as well as a method of grinding the end surface of the same. However, many problems are still unsolved.

SUMMARY OF THE INVENTION

The present invention has been made with the foregoing background in mind.

An object of the present invention is to provide a method of grinding ferrules for ribbon type optical fibers wherein the foremost end surfaces of the ferrules can be ground such that a loss due to the reflective return of an incident light beam at a joint end surface of each optical fiber as well as Fresnel loss are minimized.

Another object of the present invention is to provide a grinding tool assembly for grinding ferrules for ribbon type optical fibers by employing the foregoing method wherein each of the foremost end surfaces of each ferrule can be ground to exhibit an arched sectional contour such that the ground end surface of one ferrule comes into line contact with the ground end surface of an opposing ferrule.

Still another object of the present invention is to provide an apparatus for grinding ferrules for ribbon type optical fibers with the aid of the foregoing grinding tool assembly.

A further object of the present invention is to provide ferrules for ribbon type optical fibers wherein the foremost ends of the ferrules are ground by operating the foregoing apparatus.

According to one aspect of the present invention, there is provided a method of grinding ferrules for ribbon type optical fibers wherein the method is practiced by way of the steps of locating the foremost end surface of the ferrules opposite to a grinding surface of a grinding member in the form of a grinding disc or a grinding wheel mounted on a turntable of a grinding unit; reciprocatingly rotatably displacing the ferrules along an arched locus as seen when viewed in the direction at a right angle relative to the array of optical fibers; and grinding the foremost end surfaces of the ferrules with the grinding surface of the grinding member.

Usually, the foremost end surfaces of the ferrules are immovably held at a right angle relative to the grinding surface of the grinding member.

Alternatively, the foremost end surfaces of the ferrules may be immovably held at positions where the ferrules are inclined at a predetermined inclination angle relative to a plane perpendicular to the grinding surface of the grinding member as seen in the direction of an array of the optical fibers, in the direction at a right angle relative to an array of the optical fibers or not only in the direction of an array of the optical fibers but also in the direction at a right angle relative to an array of the optical fibers.

In this case, it is preferable that the predetermined inclination angle is set to eight degrees or more.

In addition, according to other aspect of the present invention, there is provided an apparatus for grinding ferrules for ribbon type optical fibers wherein the apparatus includes as essential components a ferrule holding member including a rectangular plate having single or plural ferrule holding holes formed thereon in an equally spaced relationship, an opposing pair of side extensions standing upright at the opposite ends of the rectangular plate at a right angle relative to the same, an opposing pair of pivotal shafts disposed outside of the side extensions, and a driving shaft disposed outside of one of the side extensions at a position located remote from the rectangular plate beyond the pivotal shafts; a supporting member having the pivotal shafts on the ferrule holding member pivotally engaged therewith; a driving unit mounted on the supporting member for reciprocatingly turnably displacing the ferrule holding member to turn about the pivotal shafts on the ferrule holding member via the driving shaft; a connecting rod bridged between a driving shaft of the driving unit and the driving shaft on the ferrule holding member so as to allow the ferrule holding member to reciprocatingly turn about the pivotal shafts on the ferrule holding member via the connecting rod; a grinding member in the form of a grinding disc or a grinding wheel mounted on a frame of the apparatus, a grinding surface of the grinding member being located opposite to the foremost end surfaces of the ferrules; grinding position adjusting means mounted on the supporting member at the intermediate position of the same for adjustably determining a grinding position to be assumed by the ferrules relative to the grinding member, biasing means for normally biasing the supporting member in the upward direction so as to allow the supporting member to turn about the intermediate position thereof in the downward direction; and a base board mounted on the frame of the apparatus for turnably supporting the supporting member so as to allow the supporting member to turn about the intermediate position thereof; whereby a grinding operation is performed for the ferrules held on the ferrule holding member by rotating the grinding member under a condition that the grinding position to be assumed by the ferrules is properly determined against the biasing force of the biasing means by actuating the grinding position adjusting means as the ferrules held on the ferrule holding member are turnably displaced via the connecting rod to reciprocatingly turn about the pivotal shafts along an arched locus as seen in the direction at a right angle relative to an array of the optical fibers.

Usually, an electric motor including a speed reducing unit is employed for the driving unit.

In addition, a micrometer rotatably mounted on the supporting member is employed for the grinding position determining means.

Additionally, a compression spring received in a hole on the base board is employed for the biasing means. The compression spring is normally compressed by rotationally tightening a grinding pressure adjusting bolt adjustably mounted on the supporting member.

To practically perform a grinding operation, a side surface of the grinding member is usually used as grinding means. Alternatively, a circumferential surface of the grinding member may be used as grinding means. After completion of the grinding operation, each of the ground surfaces of the ferrules exhibits an arched sectional shape as seen in the direction of an array of the optical fibers, in the direction at a right angle relative to an array of the optical fiber or not only in the direction of an array of the optical fibers but also in the direction at a right angle relative to an array of the optical fibers.

As a modified mode for carrying out the present invention, a grinding operation may be performed with the supporting member, the base board and other associated components mounted in an upright standing state on the frame of the apparatus while the grinding member is supported above the frame of the apparatus.

According to the present invention, since the ground end surface of one ferrule comes in line contact with the ground end surface of an opposing ferrule along a single line on the arched contour of the ground surface of each ferrule, the aforementioned drawbacks inherent to the conventional ferrules can be substantially eliminated.

It should be noted that the present invention fails to correct or eliminate an error derived from the grinding angle as seen in the direction of an array of the optical fibers. However, in view of the fact that an opposing pair of ferrules come in line contact with each other with a very small contact area therebetween, there hardly arises an adverse influence, because after they are inserted into an alignment sleeve, they are squeezed such that they are tightly jointed to each other by the action of compression springs or the like.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which:

FIG. 5(*b*) is a fragmentary front view of the grinding tool assembly shown in FIG. 5(*a*):

FIG. 8(*b*) is a sectional front view of the optical connector shown in FIG. 8(*a*); and FIGS. 8(*c*) and 8(*d*) are views, respectively, each of which illustrates by way of a sectional view the structure of a single otical fiber.

DESCRIPTION OF THE PREFERRED EMBODIMENTS

The present invention will be described in detail hereinafter with reference to the accompanying drawings which illustrate preferred embodiments of the present invention.

Figure 1:
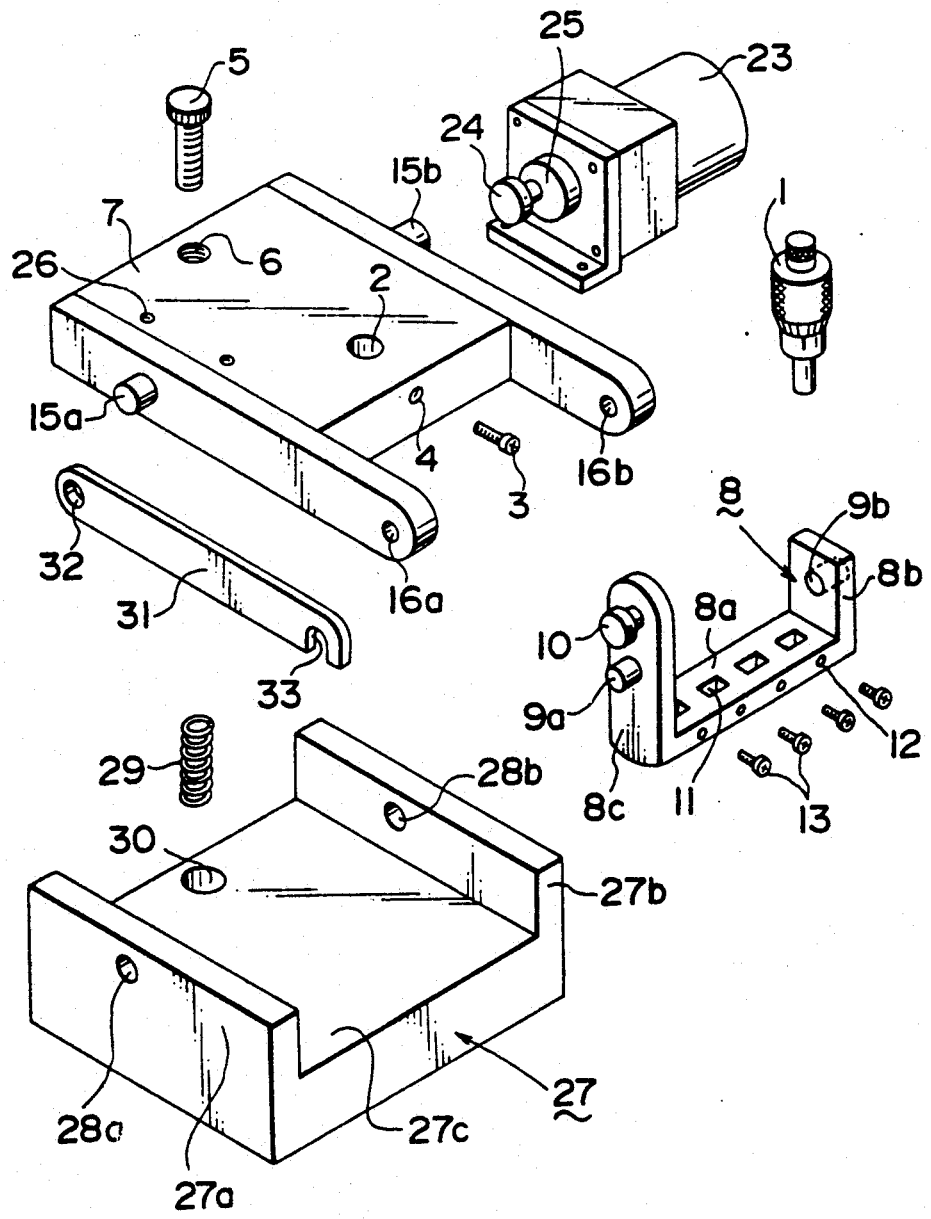
FIG. 1 is a perspective view of a grinding tool assembly employed for an apparatus for grinding ferrules for ribbon type optical fibers in accordance with a first embodiment of the present invention, particularly illustrating components constituting the grinding tool assembly in a disassembled state.

FIG. 1 is a perspective view of a grinding tool assembly for a grinding unit employable for practicing a method of grinding ferrules for ribbon type optical fibers in accordance with a first embodiment of the present invention, particularly showing components constituting the grinding tool assembly in a disassembled state.

A ferrule holding member 8 is designed in a substantially U-shaped contour, and a plurality of ferrule holding holes 11 (four ferrule holding holes in the illustrated case) are drilled through the ferrule holding member 8 at an intermediate part 8*a* of the same in an equally spaced relationship as seen in the transverse direction of the grinding tool assembly. Each ferrule holding hole 11 exhibits a rectangular contour, and opposite longer sides of the ferrule holding hole 11 extend in the transverse direction of the grinding tool assembly. Since the respective ferrule holding holes 11 are arranged in an equally spaced relationship in the above-described manner, an array of ribbon type optical fibers, i.e., an array of ferrules for the ribbon type optical fibers inserted through the ferrule holding holes 11 at the intermediate part 8*a* of the ferrule holding member 8 extends in the transverse direction of the grinding tool assembly.

The same number of female-threaded holes 12 as that of the ferrule holding holes 11 are formed on the front side wall of the intermediate part 8*a* of the ferrule holding member 8 so that a plurality of ferrules inserted through the ferrule holding holes 11 are immovably held by tightening corresponding set-screws 13.

Figure 2:
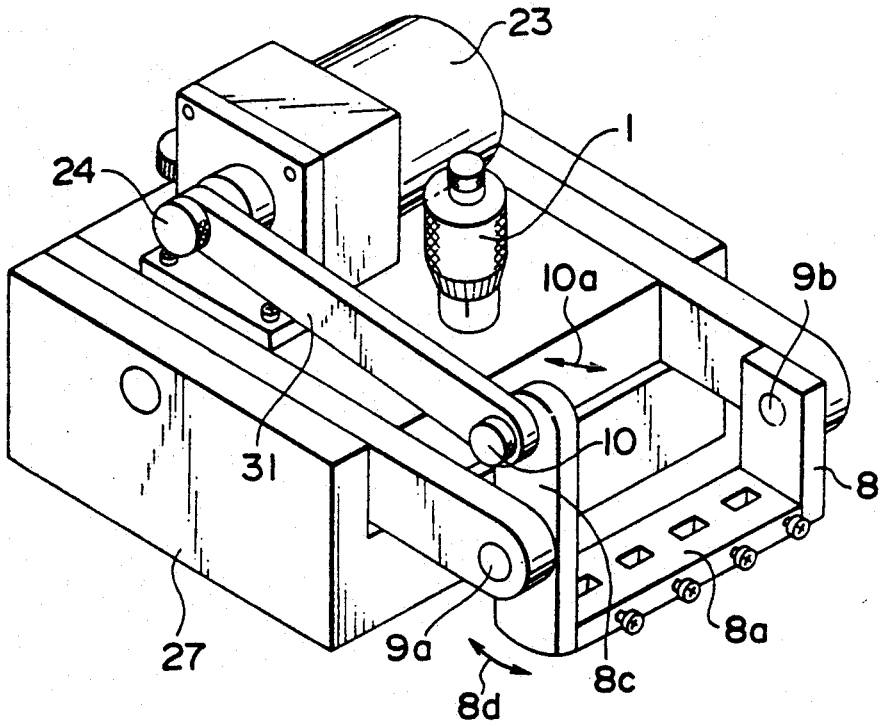
FIG. 2 is a perspective view of the grinding tool assembly for the apparatus shown in FIG. 1, particularly illustrating that respective components constituting the grinding tool assembly are assembled together.

The ferrule holding member 8 includes side extensions 8*b* and 8*c* on which an opposing pair of pivotal shafts 9*a* and 9*b* are integrally disposed at the same positions as measured from the intermediate part 8*a* of the ferrule holding member 8. In addition, the ferrule holding member 8 includes a driving shaft 10 for reciprocatingly turnably displacing the ferrule holding member 8. As is best seen in FIG. 2, the driving shaft 10 is located at a remote position away from the intermediate part 8*a* of the ferrule holding member 8 on an extension line extending from the same past the left-hand pivotal shaft 9*a*.

The grinding tool assembly includes a supporting member 7 on which an opposing pair of bearing holes 16*a* and 16*b* are formed at the foremost end part thereof. In addition, an opposing pair of supporting shafts 15*a* and 15*b* are disposed on opposite side walls of the supporting member 7 at intermediate positions of the same.

The pivotal shafts 9*a* and 9*b* on the ferrule holding member 8 are pivotally fitted into the bearing holes 16*a* and 16*b* so that the ferrule holding member 8 is turnably supported by the supporting member 7.

An electric motor 23 including a reduction gear is installed on the supporting member 7 to serve as a driving unit. Specifically, the motor 23 is firmly installed on the supporting member 7 by tightening bolts (not shown) inserted through holes 26. A circular disc 25 is fixedly mounted on a driving shaft of the motor 23, and an eccentric shaft 24 is disposed on the circular disc 25 at a position offset from the center axis of the same by a predetermined distance.

A hole 2 for firmly holding a micrometer 1 is formed on the supporting member 7 at a position located forward of a line extending between the supporting shafts 15*a* and 15*b*. The micrometer 1 serves as a grinding position adjusting device for finely adjustably determining the position where a surface at the foremost end of each ferrule is ground by rotating a grinding wheel. After the micrometer 1 is inserted into the hole 2, it is firmly held in the hole 2 by tightening a set screw 3 threadably inserted into a female-threaded hole 4 on the front side wall of the supporting member 7.

To properly adjust the intensity of grinding pressure to be imparted to each ferrule, a female-threaded hole 6 which serves as a grinding pressure adjusting member is formed on the supporting member 7 at a position located behind the line extending between the supporting 15*a* and 15*b* so that a grinding pressure adjusting bolt 5 is threadably inserted into the female-threaded hole 6.

As shown in FIG. 2, a connecting rod 31 is bridged between the driving shaft 10 and the eccentric shaft 24. Referring to FIG. 1, a bearing hole 32 is formed at the left-hand end of the connecting rod 31 so that the eccentric shaft 24 is supported with the aid of the bearing hole 32, while an engagement groove 33 is formed at the right-hand end of the connecting rod 31 so that the driving shaft 10 is operatively connected to the eccentric shaft 24 via the engagement groove 33.

Additionally, the grinding tool assembly includes a base board 27 having a substantially U-shaped cross-sectional contour, and an opposing pair of bearing holes 28*a* and 28*b* are formed on upright standing portions 27*a* and 27*b* of the base board 27.

The supporting shafts 15*a* and 15*b* are fitted into the bearing holes 28*a* and 28*b* on the base board 27 so that the supporting member 7 is turnably supported on the base board 27 with the aid of the supporting shafts 15*a* and 15*b* and the bearing holes 28*a* and 28*b*. A hole 30 for receiving a compression spring 29 is formed on a bottom surface 27*c* of the base board 27 at the position corresponding to the female-threaded hole 6 on the supporting member 7.

As the grinding pressure adjusting bolt 5 is rotated on the supporting member 7 in the direction of tightening, the lowermost end of the bolt 5 collides with the upper end of the compression spring 29 which in turn is compressed by the bolt 5.

Specifically, FIG. 2 is a perspective view of the grinding tool assembly, particularly illustrating how the respective components constituting the grinding tool assembly are assembled together.

As the motor 23 is driven, the eccentric shaft 24 is eccentrically rotated so as to turn the side extensions 8*b* and 8*c* of the ferrule holding member 8 about the pivotal shafts 9*a* and 9*b* in the arrow-marked direction designated by reference numeral 10*a*. At this time, the intermediate part 8*a* of the ferrule holding member 8 is turned about the pivotal shafts 9*a* and 9*b* in the arrow-marked direction designated by reference numeral 8*d*.

Figure 3:
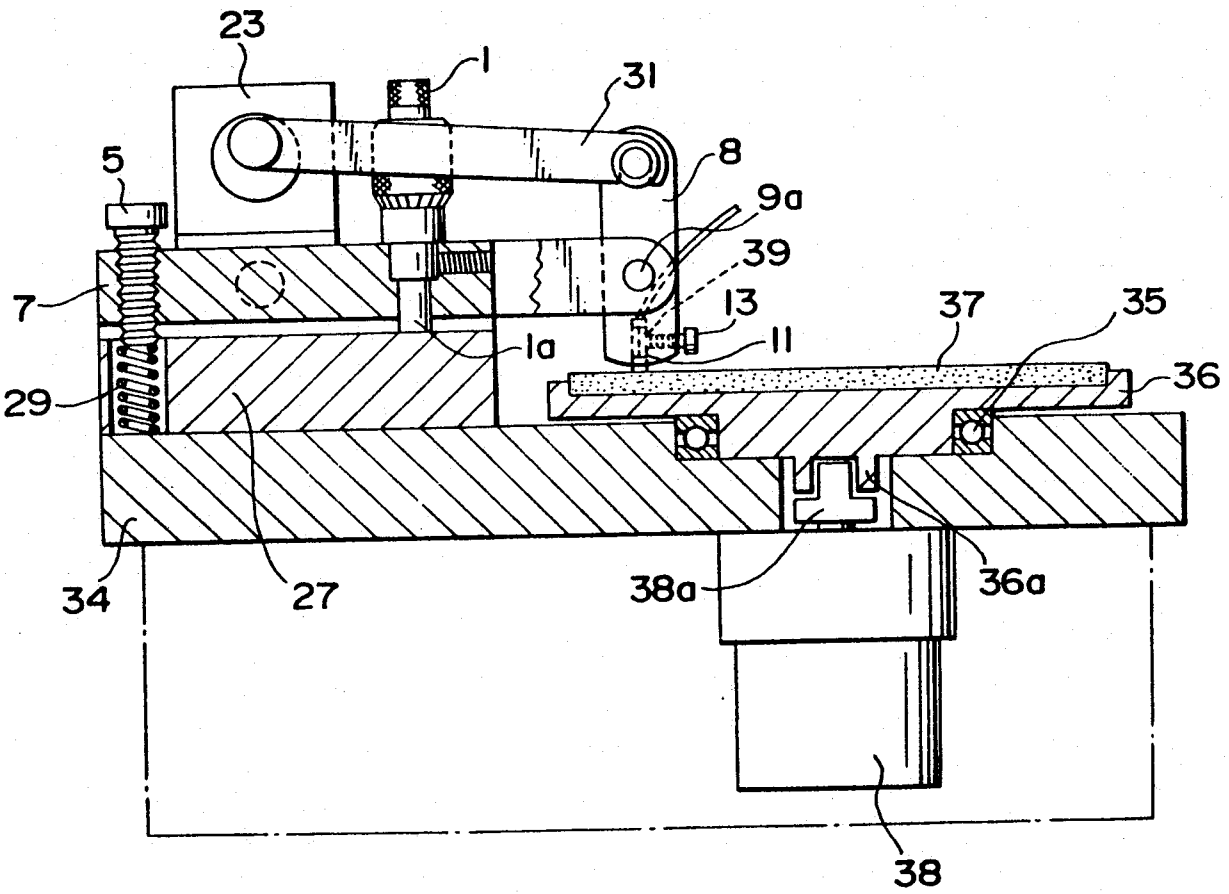
FIG. 3 is a partially sectioned front view of the apparatus, particularly illustrating that the grinding tool assembly shown in FIG. 2 is mounted on a frame of the apparatus.

FIG. 3 is a fragmentary sectional front view of the grinding unit on which the grinding tool assembly for grinding ferrules for ribbon type optical fibers as shown in FIG. 2 in accordance with the embodiment of the present invention is installed.

The grinding unit includes a frame 34 on which the grinding tool assembly shown in FIG. 2 is mounted.

In addition, the grinding unit is equipped with an electric motor 38 for driving a turntable 36, and a driving shaft 38*a* of the motor 38 is operatively connected to a center shaft 36*a* of the turntable 36 which is turnably supported by a thrust bearing 35.

A grinding board 37 serving as a grinding member is placed on the turntable 36.

As is apparent from the drawing, the compression spring 29 is depressed by the grinding pressure adjusting bolt 5 on the supporting member 7, and the supporting member 7 is normally biased to turn about the supporting shafts 15*a* and 15*b* in the clockwise direction by its own dead weight. However, since the lowermost end 1*a* of the micrometer 1 comes in contact with the bottom surface of the base board 27 on the frame 34, the ferrule holding member 8 is located at the position away from the grinding board 37 by a predetermined distance.

Next, a mode of grinding operation for grinding end surfaces of the respective ferrules by driving the grinding unit will be described below.

First, the ferrules 39 are inserted into the corresponding ferrule holding holes 11 from above and they are then immovably held by tightening the set-screws 13. While the foregoing state is maintained, the end surfaces of the ferrules are not brought into contact with the grinding board 37.

As the micrometer 1 is rotated in the reverse direction so as to allow its lowermost end 1*a* to be displaced in the upward direction, i.e., in the rearward direction, the end surfaces of the ferrules 39 are displaced toward the working surface of the grinding board 37 until they come in contact with the same.

After the end surfaces of the ferrules 39 come in contact with the working surface of the grinding board 37, the grinding pressure adjusting bolt 5 is properly adjusted such that they squeeze the grinding board 37 with a predetermined intensity of pressure.

After completion of the preparative operation as mentioned above, a power source switch (not shown) is turned on to activate the motor 23 and the motor 38.

Now, the ferrule holding member 8 is ready to start reciprocating turning movement about the pivotal shafts 9*a* and 9*b* within a predetermined angular range.

Figure 4:
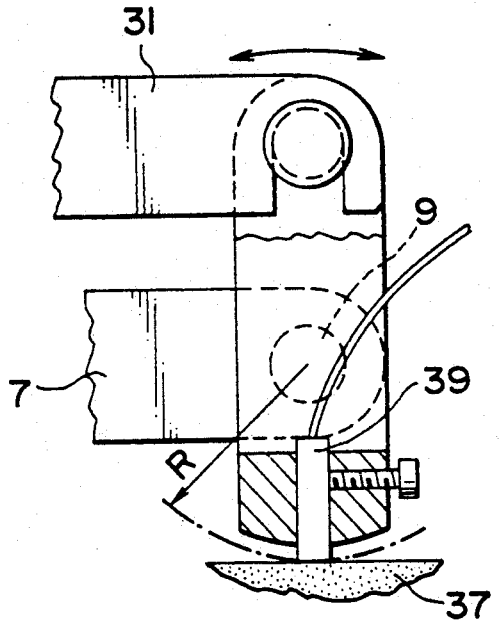
FIG. 4 is a fragmentary front view of the grinding tool assembly, particularly illustrating that the ferrules are immovably held in the corresponding ferrule holding holes on a ferrule holding member in an upright standing state.

When a predetermined period of time has elapsed, the end surfaces of the ferrules 39 are ground to exhibit an arched sectional cylindrical contour as shown in FIG. 4.

Referring to the drawing, the radius of the arc is represented by a distance R between the center of each of the pivotal shafts 9*a* and 9*b* and the foremost end of each ferrule.

Figure 5B:
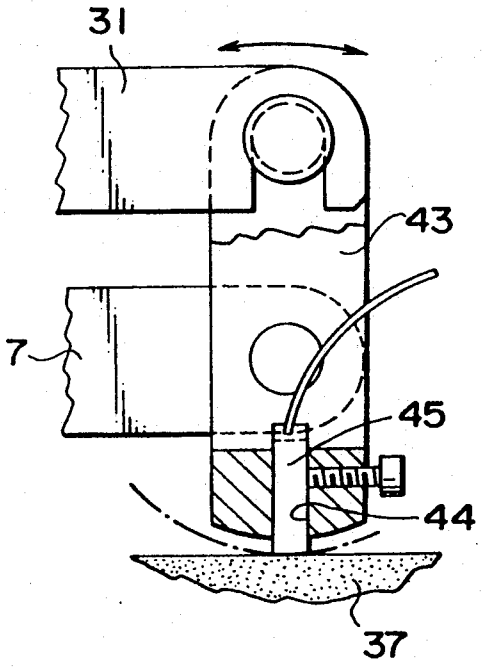
FIG. 5(*a*) is a fragmentary side view of a grinding tool assembly employed for an apparatus for grinding ferrules for ribbon type optical fibers in accordance with a second embodiment of the present invention, particularly illustrating that the ferrules are immovably held in the corresponding ferrule holding holes on a ferrule holding member in an inclined state.
Figure 5A:
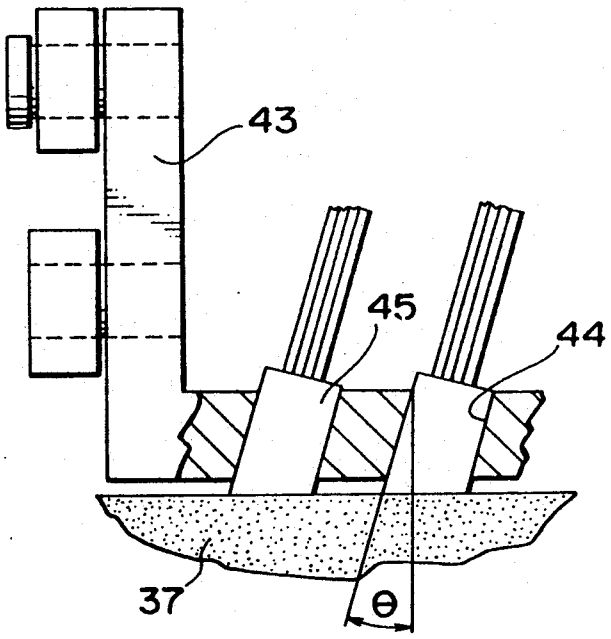

Next, FIGS. 5(*a*) and 5(*b*) shows a ferrule holding member employable for a grinding tool assembly in accordance with a second embodiment of the present invention wherein FIG. 5(*a*) is a partially sectioned side view of a ferrule holding member and FIG. 5(*b*) is a partially sectioned front view of the same.

As is best seen in FIG. 5(*a*), ferrule holding holes 44 on the ferrule holding member 43 are inclined together with optical fibers by an angle of $\theta$ degrees relative to a plane perpendicular to the working surface of the grinding board 37.

When a grinding operation is performed in the same manner as mentioned above after ferrules 45 are immovably held in the corresponding ferrule holding holes 44, the lowermost end surfaces of the ferrules 45 are ground to exhibit an arched sectional contour with an inclination angle of $\theta$ as seen in the direction of an array of the optical fibers.

Preferably, the inclination angle $\theta$ is set to eight degrees or more.

Figure 6:
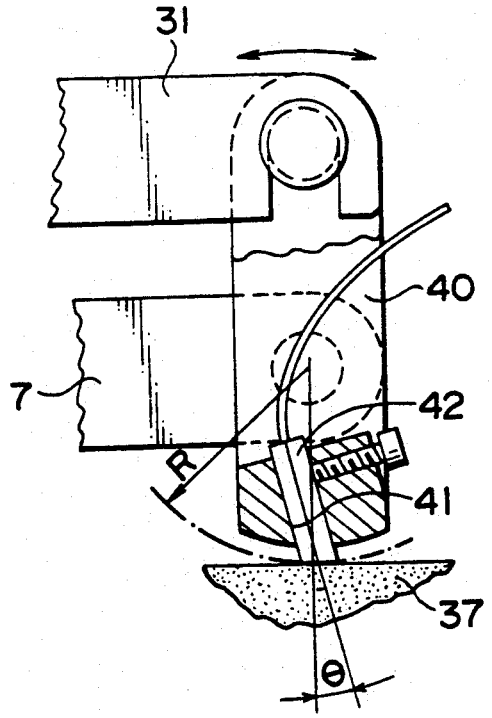
FIG. 6 is a fragmentary front view of a grinding tool assembly employed for an apparatus for grinding ferrules for ribbon type optical fibers in accordance with a third embodiment of the present invention, particularly illustrating that the ferrules are immovably held in ferrule holding holes on a ferrule holding member in an inclined state.

Next, FIG. 6 is a partially sectioned front view of a ferrule holding member employable for a grinding tool assembly in accordance with a third embodiment of the present invention.

In this embodiment, ferrule holding holes 41 on a ferrule holding member 40 are formed through the same such that they are inclined in the direction at a right angle relative to the direction of an array of optical fibers by an angle $\theta$ as measured from a plane perpendicular to the working surface of the grinding board 37.

When a grinding operation is performed, the end surfaces of the ferrules 42 are ground such that their center axes are inclined by an inclination angle of $\theta$ in the direction at a right angle relative to the direction of an array of the optical fibers to exhibit an arched sectional contour. Also in this embodiment, it is recommended that the inclination angle $\theta$ also be set to eight degrees or more.

Alternatively, the present invention may be carried out by combining the embodiment shown in FIGS. 5(*a*) and 5(*b*) with the embodiment shown in FIG. 6. In such a modified embodiment as mentioned above, the orientation of inclination of the ferrule holding holes on the ferrule holding member is determined to coincide either with the direction of the array of optical fibers or with the direction at a right angle relative to the direction of the array.

Figure 7:
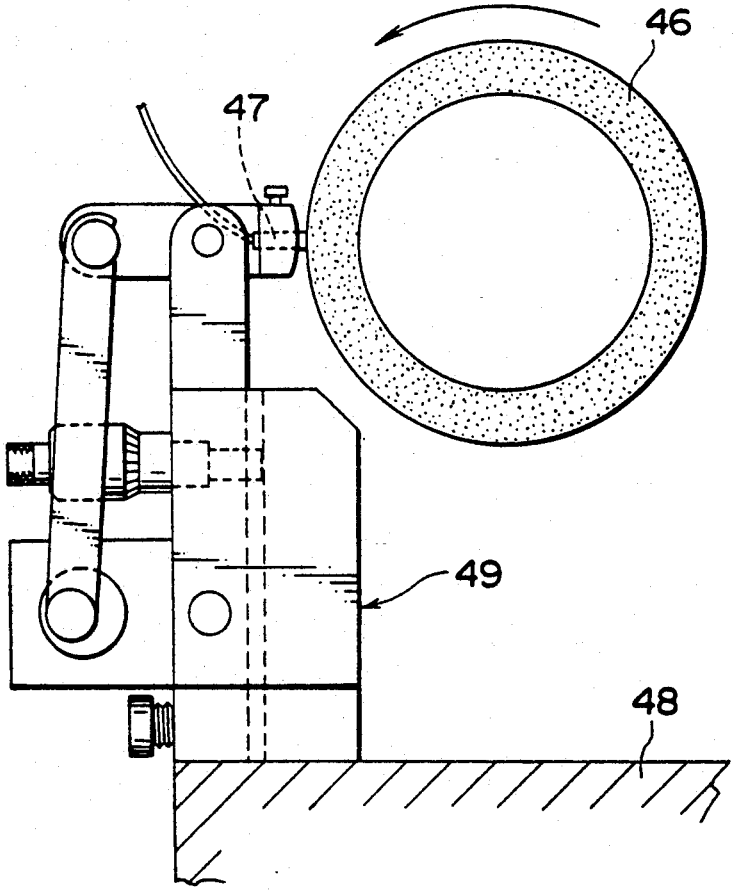
FIG. 7 is an enlarged fragmentary front view of an apparatus for grinding ferrules for ribbon type optical fibers in accordance with a fourth embodiment of the present invention, particularly illustrating that a grinding tool assembly is mounted on a frame of the apparatus in an upright standing state.
Figure 8A:
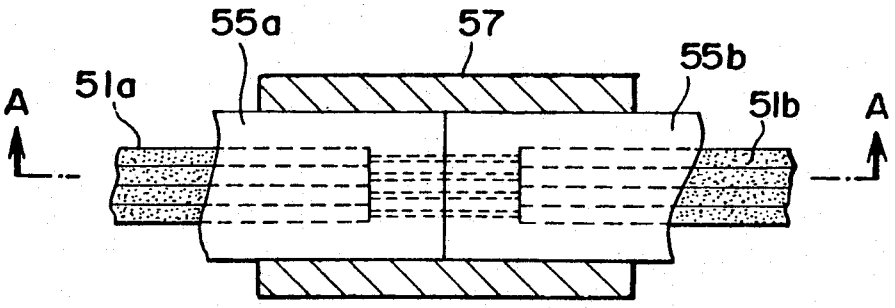
FIG. 8(*a*) is a plan view of a conventional optical connector for four-cored ribbon type optical fibers, particularly illustrating by way of example that end surfaces of one ribbon type optical fibers are jointed to those of opposing ribbon type optical fibers at a right angle relative to the longitudinal direction of the optical fibers.
Figure 8B:
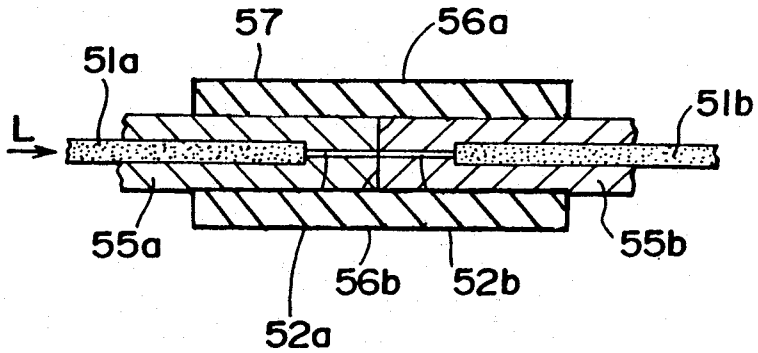
Figure 8C:
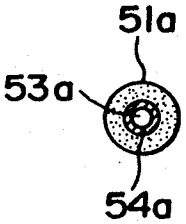
Figure 8D:
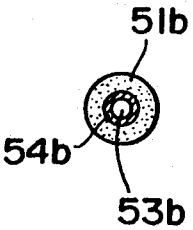

Next, FIG. 7 is an enlarged fragmentary sectional view of an apparatus for grinding ferrules for optical fibers in accordance with a fourth embodiment of the present invention.

In this embodiment, a grinding tool assembly 49 is installed on a frame 48 in an upright standing state so that the foremost end surfaces of ferrules 47 for ribbon type optical fibers are ground with the circumferential surface of a grinding wheel 46 serving as a grinding member.

The present invention has been described above with four preferred embodiments thereof wherein end surfaces of ferrules for ribbon type optical fibers are ground with the aid of a grinding tool assembly of the aforementioned type. However, the present invention should not be limited only to the foregoing application but it may equally be applied to optical connectors, optical switches, optical attenuators or the like each including ferrules to be ground.

As is apparent from the above description, when a method of grinding ferrules for ribbon type optical fibers in accordance with the present invention is employed, end surfaces of the ferrules are ground to exhibit an arched sectional contour, respectively. Thus, when an opposing pair of end surfaces of ferrules for ribbon type optical fibers are jointed to each other, they come in line contact with each other, resulting in minimizing loss due to both reflective return of an incident light beam at the jointed end surfaces Fresnel loss.

An apparatus for practicing the method of the present invention with the aid of a grinding tool assembly assures that the end surfaces of the ferrules for ribbon type optical fibers are ground to exhibit an arched sectional contour.

When the apparatus is constructed such that ferrule holding holes for a ferrule holding member are formed such that they are inclined by a predetermined angle (preferably, eight degrees or more) either in the direction of an array of optical fibers or in the direction at a right angle relative to the direction of an array of optical fibers, a grinding operation can be performed such that an end surface of one ferrule comes in line contact with an end surface of an opposing ferrule in the direction at a right angle relative to an axis of each optical fiber not only at an apex in the central region of the end surface of the ferrule but also in regions other than the apex.

With the apparatus of the present invention, since a plurality of optical components can simultaneously be ground, the grinding operation can be accomplished within a shorter period of time at a remarkably improved efficiency.

The optical fiber ferrules ground by employing the above-mentioned method and apparatus of the present invention have extremely excellent optical properties as connector components, and can be manufactured at low cost.

While the present invention have been described above only with respect to four preferred embodiments thereof, it should of course be understood that the present invention should not be limited only to the embodiments since various changes or modifications may be made without departure from the scope of the invention as defined by the appended claims.

What is claimed is:

1. An apparatus for grinding a ferrule for a ribbon type optical fiber, comprising:

a ferrule holding member including a rectangular plate having opposite ends and at least a single ferrule holding hole therein;

an opposing pair of side extensions having outside surfaces extending from the opposite ends of said rectangular plate, said side extensions being perpendicular to said rectangular plate;

an opposing pair of pivotal shafts disposed on respective outside surfaces of said side extensions; and a driving shaft disposed on an outside surface of one of said side extensions at a position remote from said rectangular plate, one of said pivotal shafts being interposed between said driving shaft and said rectangular plate;

a supporting member having supporting shafts thereon, said pivotal shafts on said ferrule holding member being pivotally engaged therewith;

a driving unit mounted on said supporting member for reciprocatingly turnably displacing said ferrule holding member to turn about said pivotal shafts on said ferrule holding member via said driving shaft;

a connecting rod bridged between a driving shaft of said driving unit and said driving shaft on said ferrule holding member so as to allow said ferrule holding member to reciprocatingly turn about said pivotal shafts on said ferrule holding member via said connecting rod;

a grinding member mounted on a frame of said apparatus, a grinding surface of said grinding member being located opposite to the foremost end surface of said ferrule;

grinding position adjusting means mounted on said supporting member at an intermediate position thereof for adjustably determining a grinding position to be assumed by said ferrule relative to said grinding member;

biasing means for normally biasing said supporting member in a direction away from said frame so as to allow said supporting member to turn about said supporting shafts; and a base board mounted on said frame of said apparatus for turnably supporting said supporting member so as to allow said supporting member to turn about said supporting shafts;

whereby a grinding operation is performed for said ferrule held on said ferrule holding member by rotating said grinding member under a condition that said grinding positions to be assumed by said ferrule are properly determined against the biasing force of said biasing means by actuating said grinding position adjusting means as said ferrule held on said ferrule holding member is turnably displaced via said connecting rod.

2. The apparatus as claimed in claim 1, wherein a plurality of said ferrule holding holes are formed in said rectangular plate, said holes being equally spaced therein.

3. The apparatus as claimed in claim 1, wherein said grinding member is prepared in the form of a grinding disc or a grinding wheel.

4. The apparatus as claimed in claim 2, wherein the foremost end surface of said ferrule held on said ferrule holding member is immovably held at a position at a right angle relative to said grinding surface of said grinding member.

5. The apparatus as claimed in claim 1, wherein the foremost end surface of said ferrule held on said ferrule holding member is immovably held at a position where said ferrule is inclined by a predetermined inclination angle relative to a plane perpendicular to said grinding surface of said grinding member.

6. The apparatus as claimed in claim 5, wherein said predetermined inclination angle is set to eight degrees or more.

7. The apparatus as claimed in claim 1, wherein said driving unit is an electric motor including a reduction gear.

8. The apparatus as claimed in claim 1, wherein said grinding position adjusting means is a micrometer rotatably mounted on said supporting member.

9. The apparatus as claimed in claim 1, wherein said biasing means is a compression spring received in a hole on said base board, said compression spring being normally compressed by rotationally tightening a grinding pressure adjusting bolt adjustably mounted on said supporting member.

10. The apparatus as claimed in claim 1, wherein said grinding surface of said grinding member is a side surface of the same.

11. The apparatus as claimed in claim 1, wherein said grinding surface of said grinding member is a circumferential surface of the same.

12. The apparatus as claimed in claim 1, wherein said grinding operation is performed with such an upright attitude that said supporting member, said base board and other associated components are mounted in an upright standing state on said frame of said apparatus while said grinding member is supported above said frame of the same.

* * * * *